US010027004B2

(12) United States Patent
Savage et al.

(10) Patent No.: US 10,027,004 B2
(45) Date of Patent: Jul. 17, 2018

(54) APPARATUS INCLUDING A DIELECTRIC MATERIAL DISPOSED IN A WAVEGUIDE, WHEREIN THE DIELECTRIC PERMITTIVITY IS LOWER IN A MODE COMBINER PORTION THAN IN A MODE TRANSITION PORTION

(71) Applicant: THE BOEING COMPANY, Chicago, IL (US)

(72) Inventors: Larry L. Savage, Huntsville, AL (US); Ted R. Dabrowski, Madison, AL (US); Corey M. Thacker, Madison, AL (US)

(73) Assignee: THE BOEING COMPANY, Chicago, IL (US)

( * ) Notice: Subject to any disclaimer, the term of this patent is extended or adjusted under 35 U.S.C. 154(b) by 60 days.

(21) Appl. No.: 15/222,836

(22) Filed: Jul. 28, 2016

(65) Prior Publication Data

US 2018/0034126 A1 Feb. 1, 2018

(51) Int. Cl.

| | |
|---|---|
| ***H01P 1/16*** | (2006.01) |
| ***H01P 3/16*** | (2006.01) |
| ***H01P 3/12*** | (2006.01) |
| ***H01P 11/00*** | (2006.01) |

(52) U.S. Cl.

CPC ..... *H01P 1/16* (2013.01); *H01P 3/122* (2013.01); *H01P 3/16* (2013.01); *H01P 11/001* (2013.01)

(58) Field of Classification Search

CPC .. H01P 1/16; H01P 1/163; H01P 3/122; H01P 5/024; H01P 11/001

USPC ..... 333/21 R, 34

See application file for complete search history.

(56) References Cited

U.S. PATENT DOCUMENTS

| | | | | |
|---|---|---|---|---|
| 3,146,414 | A * | 8/1964 | Marcatili | H01P 1/163 333/248 |
| 3,413,641 | A | 11/1968 | Turrin | |
| 3,603,899 | A | 9/1971 | Gyorgy et al. | |
| 4,510,469 | A * | 4/1985 | Bowman | H01P 1/16 333/137 |
| 5,109,232 | A * | 4/1992 | Monte | H01Q 25/04 333/126 |
| 2005/0151695 | A1 | 7/2005 | Chen et al. | |

OTHER PUBLICATIONS

Balanis, "Advanced Engineering Electromagnetics", Wiley, New Jersey, United States, 2012, pp. 483 through 500.

Nagelberg, et al., "Mode Conversion in Circular Waveguides", Bell System Technical Journal, vol. 44, Issue 7, Sep. 1965, pp. 1321 through 1338.

Extended European Search Report for Application No. 17172765.4, dated Dec. 11, 2017, 9 pgs.

Leong, M. S., et al., "Modal analysis of dielectric-sleeve-loaded circular waveguide for dual-mode radiator applications," IEE Proceedings, vol. 134, No. 4, Aug. 1987, 369-374.

* cited by examiner

*Primary Examiner* — Benny Lee

(74) *Attorney, Agent, or Firm* — Toler Law Group, PC

(57) ABSTRACT

An apparatus includes a waveguide. The waveguide includes a waveguide wall having a shape associated with a dominant propagation mode. The waveguide includes a first dielectric material having a cross-sectional area that varies along a length of a portion of the waveguide.

20 Claims, 8 Drawing Sheets

APPARATUS INCLUDING A DIELECTRIC MATERIAL DISPOSED IN A WAVEGUIDE, WHEREIN THE DIELECTRIC PERMITTIVITY IS LOWER IN A MODE COMBINER PORTION THAN IN A MODE TRANSITION PORTION

FIELD OF THE DISCLOSURE

The present disclosure relates to waveguides.

BACKGROUND

Microwave antennas may emit energy having a radiation pattern that includes a main lobe and side lobes. The side lobe energy may be undesirable. For example, the side lobe energy may draw energy from the main lobe and may make detection of an emitter easier. Side lobe energy may be reduced by reducing longitudinal edge currents at the mouth of an aperture antenna or a waveguide. The longitudinal edge currents may be reduced by propagating energy in a mixed propagation mode including a dominant propagation mode and a higher order propagation mode to cancel longitudinal current. The mixed propagation mode may result from converting energy propagating in the dominant propagation mode to energy propagating in the higher order propagation mode. A dimension (e.g., a cross-sectional area of an interior region) of the waveguide may be varied along its length in order to present a boundary value perturbation that causes energy propagating in the dominant propagation mode to convert to energy propagating in the higher order propagation mode. For example, the wall of the waveguide may include a flare, an iris, a groove, or a step to convert energy to the higher order propagation mode. However, varying the cross-sectional area of the waveguide wall may be undesirable. For example, many systems include waveguides that have a substantially constant cross-sectional area and it would be costly to replace the waveguides in these systems.

SUMMARY

In a particular implementation, an apparatus includes a waveguide. The waveguide includes a waveguide wall having a shape associated with a dominant propagation mode. The waveguide includes a first dielectric material having a cross-sectional area that varies along a length of at least a portion of the waveguide.

In another particular implementation, a waveguide includes a feed portion, a mode combiner portion, a mode transition portion, and an index matcher. The mode transition portion includes a dielectric material and is located between the feed portion and the mode combiner portion. The index matcher includes a dielectric material. The mode combiner portion is located between the index matcher and the mode transition portion.

In another particular implementation, a method includes receiving a signal at a waveguide. The waveguide includes a waveguide wall and a dielectric material having a cross-sectional area that varies along a length of a portion of the waveguide. A shape of the waveguide wall is associated with a dominant propagation mode. The method further includes converting a portion of the signal from the dominant propagation mode to a second propagation mode by propagating the signal through the portion of the waveguide that includes the dielectric material.

The features, functions, and advantages described herein can be achieved independently in various embodiments or may be combined in yet other embodiments, further details of which are disclosed with reference to the following description and drawings.

DETAILED DESCRIPTION

Particular embodiments of the present disclosure are described below with reference to the drawings. In the description, common features are designated by common reference numbers throughout the drawings.

The figures and the following description illustrate specific exemplary embodiments. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific embodiments or examples described below, but by the claims and their equivalents.

Figure 1A:
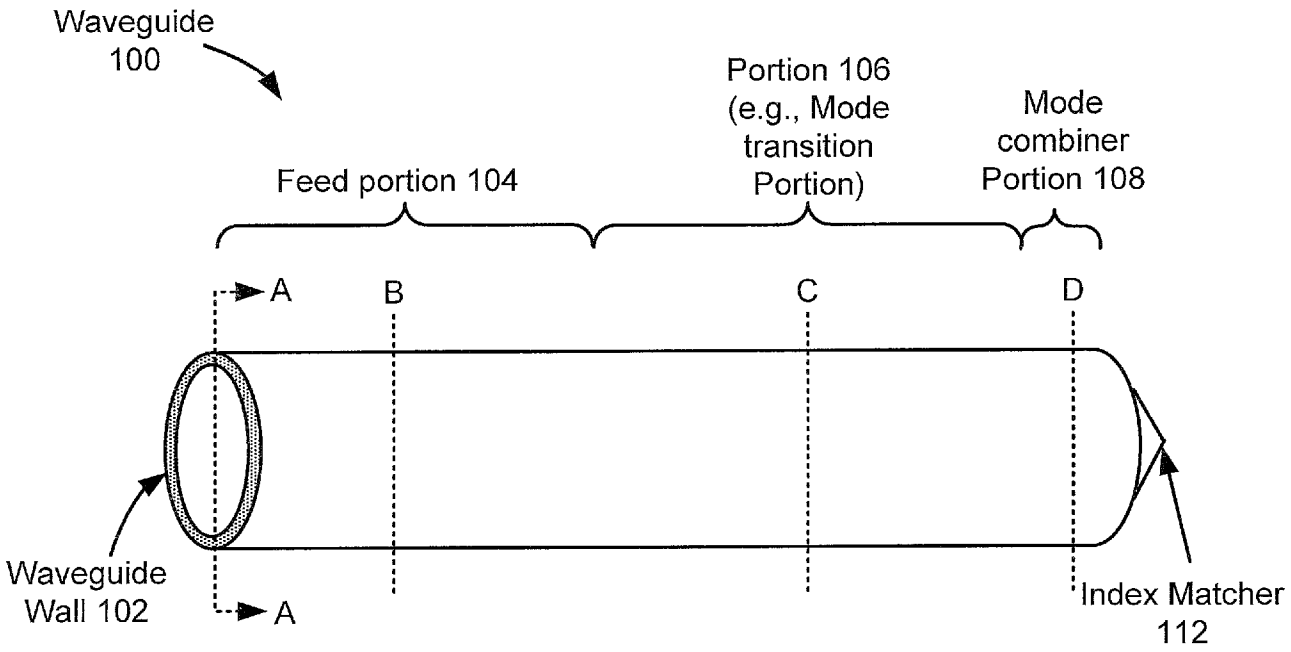
FIG. 1A illustrates a perspective view of a waveguide that includes a mode transition portion.
Figure 1B:
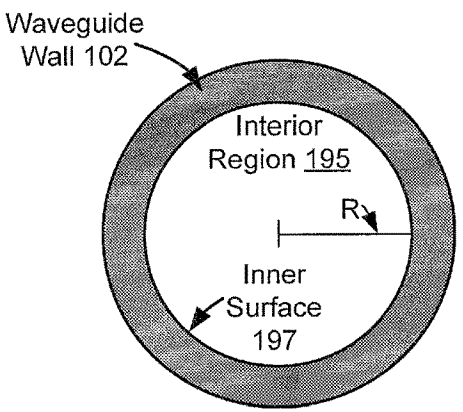
FIG. 1B illustrates a cross-section view of a feed portion of the waveguide of FIG. 1A.
Figure 1C:
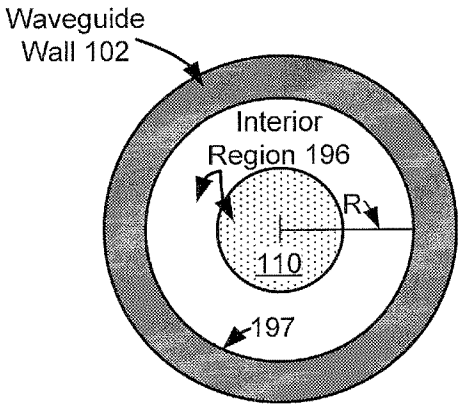
FIG. 1C illustrates a cross-section view of a mode transition portion of the waveguide of FIG. 1A.
Figure 1D:
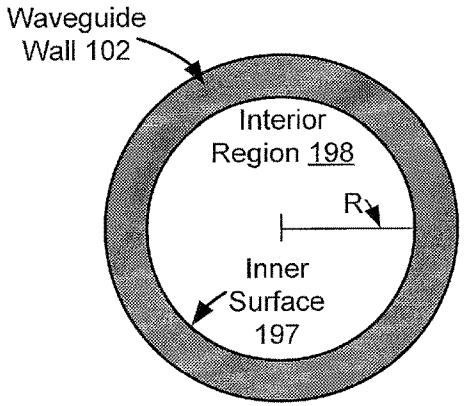
FIG. 1D illustrates a cross-section view of a mode combiner portion of the waveguide of FIG. 1A.
Figure 1E:
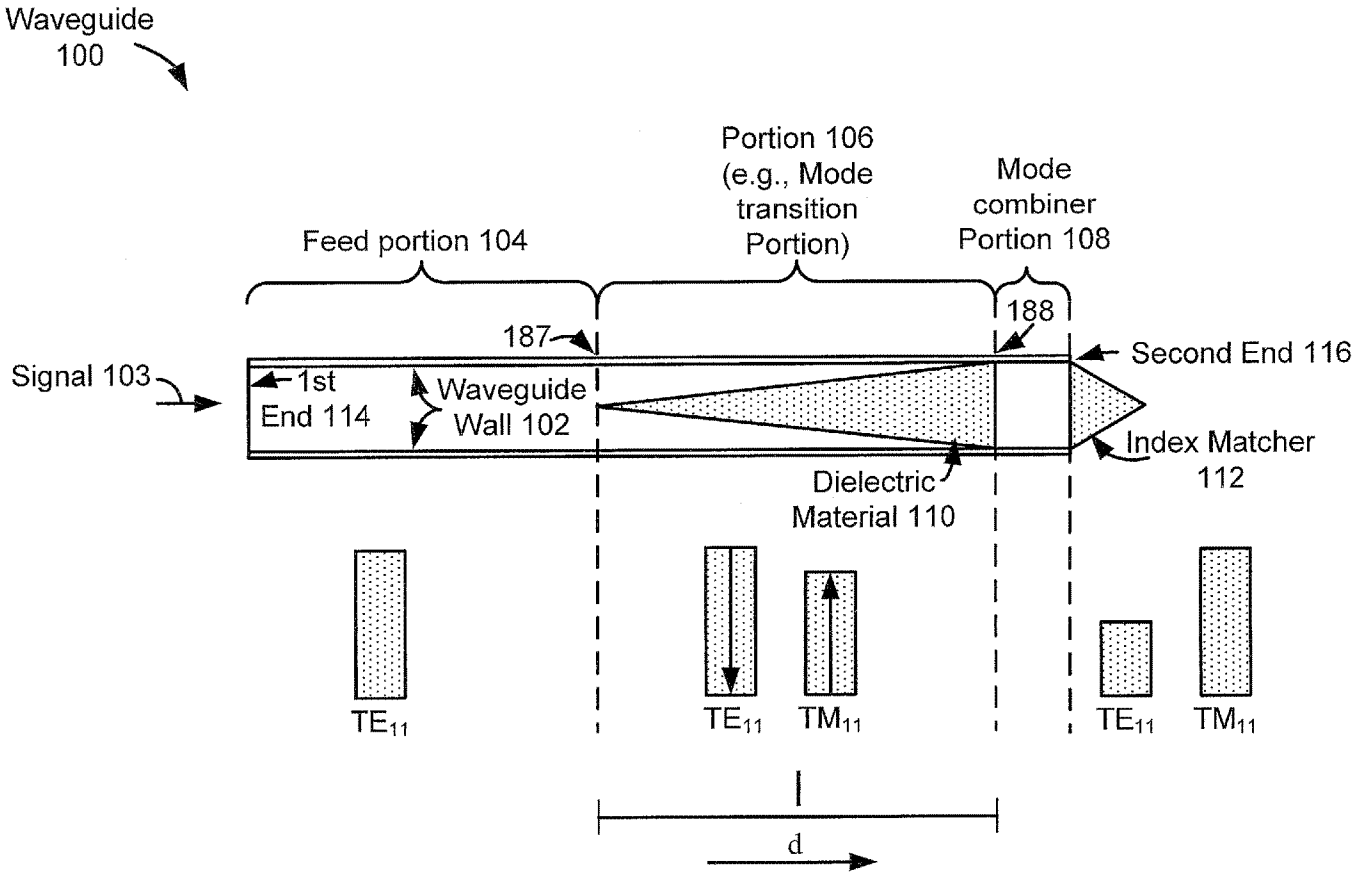
FIG. 1E illustrates a side cross-section view of the waveguide of FIG. 1A.

FIG. 1A illustrates a perspective view of a waveguide 100 including a mode transition portion (e.g., portion 106). The waveguide 100 includes a mode combiner portion 108 between the mode transition portion and an index matcher 112. FIG. 1B illustrates a cross-sectional view of the waveguide 100 of FIG. 1A along line B of FIG. 1A, FIG. 1C illustrates a cross-sectional view of the waveguide 100 of FIG. 1A along line C of FIG. 1A, and FIG. 1D illustrates a cross-sectional view of the waveguide 100 of FIG. 1A along line D of FIG. 1A. FIG. 1E illustrates a cross-sectional view of the waveguide 100 of FIG. 1A along lines A-A of FIG. 1A. As shown in FIG. 1E, the waveguide 100 includes a dielectric material 110 having a dimension (e.g., a radius, diameter, or length of a cross-section) that varies along a length of a portion 106 (e.g., a mode transition portion) of the waveguide 100. The waveguide 100 includes a waveguide wall 102 having a first end 114 and a second end 116. The waveguide wall 102 may have a cross-sectional shape (e.g., a geometry) associated with a dominant propagation mode. For example, the waveguide wall 102 may be circular (e.g., the waveguide 100 may be a circular waveguide), and the dominant propagation mode may correspond to a transverse electric 11 (TE11) mode. Alternatively, the waveguide wall 102 may be square or rectangular (e.g., the waveguide 100 may be a square waveguide or a rectangular waveguide), and the dominant propagation mode may correspond to a TE10 mode.

The waveguide 100 includes a feed portion 104 that supports propagation of energy in the dominant propagation mode. To illustrate using a circular waveguide, the feed portion 104 receives a signal 103 and the signal 103 propagates toward the portion 106 entirely or predominantly in the dominant propagation mode (e.g., TE11).

The feed portion 104 of the waveguide 100, as shown in FIG. 1A may include an interior region 195, as shown in FIG. 1B defined or bounded by an inner surface 197, as shown in FIGS. 1B, 1C and 1D of the waveguide wall 102 along the feed portion 104 of the waveguide 100. In the illustrated implementation, as shown in FIG. 1B, (e.g., for a circular waveguide), the interior region 195 has a cross-sectional area (A) corresponding to $A=\pi R^2$ (Equation 1) along a length of the feed portion 104, where R corresponds to the radius R of a cross-section of the interior region 195. In other implementations (e.g., for a square or a rectangular waveguide), the interior region 195 of the waveguide 100 has a cross-sectional shape other than a circle. In these examples, the interior region 195 of the feed portion 104 defined by the waveguide wall 102 has a cross-sectional area that is defined using a different relation than the relation of Equation 1. For example, as described above, the waveguide wall 102 may be square or rectangular (e.g., the inner surface 197 of the waveguide wall 102 may define a square or a rectangle). To illustrate, the inner surface 197 along the feed portion 104 may define a square, and the interior region 195 may have a cross-sectional area corresponding to a length (of a cross-sectional shape defined by the inner surface 197 along the feed portion 104) squared. As another example, the inner surface 197 along the feed portion 104 may define a rectangle, and the interior region 195 may have a cross-sectional area corresponding to a length of a cross-sectional shape defined by the inner surface 197 along the feed portion 104 multiplied by a width of the cross-sectional shape.

The interior region 195 of the feed portion 104 may have a lower permittivity than the interior region of the portion 106. For example, the interior region 195 of the feed portion 104 may be filled with air, which has a lower permittivity than the dielectric material 110 of the portion 106 as described in more detail below.

As shown in FIG. 1E, the signal 103 propagates from the feed portion 104 to the portion 106. The signal 103 approaching or entering the portion 106 from the feed portion 104 is propagating predominantly or entirely in the dominant propagation mode. The dielectric material 110 of the portion 106 serves to convert some portions of the signal 103 propagating in the dominant propagation mode at entry into the portion 106 (i.e., at a first end 187) to energy propagating in the second mode at a second end 188 of the portion 106.

The portion 106 of the waveguide 100 may include an interior region 196 and the waveguide wall 102 along the portion 106 of the waveguide 100. As shown in FIG. 1C, the interior region 196 is defined or bounded by the inner surface 197 of the waveguide wall 102. In some implementations (e.g., for a circular waveguide), the interior region 196 has a cross-sectional area (A) corresponding to $A=\pi R^2$ (Equation 2) along a length of the portion 106, where R corresponds to the radius R of a cross-section of the interior region 196. In other implementations (e.g., for a square or a rectangular waveguide), the interior region 196 of the waveguide 100 has a cross-sectional shape other than a circle. In these examples, the interior region 196 of the portion 106 has a cross-sectional area that is defined using a different relation than the relation of Equation 2. For example, as described above, the waveguide wall 102 may be square or rectangular (e.g., the inner surface 197 of the waveguide wall 102 may define a square or a rectangle). To illustrate, the inner surface 197 along the portion 106 may define a square, and the interior region 196 may have a cross-sectional area corresponding to a length (of a cross-sectional shape defined by the inner surface 197 along the portion 106) squared. As another example, the inner surface 197 along the portion 106 may define a rectangle, and the interior region 196 may have a cross-sectional area corresponding to a length of a cross-sectional shape defined by the inner surface 197 along the portion 106 times a width of the cross-sectional shape.

In an illustrative implementation, the interior region 196 of the portion 106 has a substantially constant cross-sectional area along the length and has the same cross-sectional area as the interior region 195 of the feed portion 104. In this implementation, the portion 106 does not include any waveguide wall perturbations.

In an illustrative implementation, as shown in FIG. 1E, the dielectric material 110 causes the signal 103 to behave as though the cross-sectional area of the interior region 196 is increasing along the length of the portion 106 without actually varying the cross-sectional area of the interior region 196. The dielectric material 110 may cause the signal 103 to behave as though the cross-sectional area of the interior region 196 is larger than the cross-sectional area of the interior region 195 of FIG. 1B, because the interior region 196 of FIG. 1C, of the portion 106 has a higher permittivity than the interior region 195 of the feed portion 104 (e.g., based on the dielectric material 110 having a larger dielectric constant than the material of the interior region 195 of the feed portion 104). For example, the interior region 195 of the feed portion may be filled with air (e.g., having a dielectric constant of one (1)) and the dielectric material 110 may have a dielectric constant that is larger than one (1). In some examples, the dielectric material 110 may be formed of a polymer.

In some implementations of a circular waveguide, the dielectric material 110 is configured to emulate a waveguide wall having an inner surface that defines a cross-sectional shape (at the second end 188 of the portion 106) having a radius that is approximately twice the radius R of the feed portion 104. In these examples, the dielectric material 110 may have a dielectric constant that is approximately four times the dielectric constant of the material or fill of the interior region 195 of the feed portion 104. For example, the interior region 195 of the feed portion 104 may be filled with air (e.g., having a dielectric constant of one (1)) and the dielectric material 110 may be formed of a dielectric material having a dielectric constant of about four (4).

Although the dielectric material 110 is illustrated as having a circular cross-section, in other implementations the dielectric material 110 may have a cross-sectional shape other than a circle. For example, as described above, the waveguide 100 may be a square or rectangular waveguide. In these examples, the dielectric material 110 has a square or rectangular cross-sectional shape. In some examples of a square waveguide 100, the dielectric material 110 has a substantially pyramidal shape when the dielectric material 110 is linearly tapered. In these examples, the dielectric material 110 may be configured to emulate a waveguide wall having an inner surface that defines a cross-sectional shape (e.g., a square or rectangular cross-sectional shape) at the second end 188 of the portion 106 having a dimension other than a radius (e.g., having a length or a width) that is approximately or at least twice a value of the corresponding dimension of the cross-sectional shape of the interior region 195 of the feed portion 104.

In this manner, the portion 106 (including the dielectric material 110) may emulate a perturbation in the waveguide wall 102 and serves to convert energy from the dominant (e.g., a TE11) propagation mode to the secondary (e.g., a TM11) propagation mode without using perturbations in the waveguide wall 102. Thus, the portion 106 may convert propagation modes while having the same (or substantially the same) cross-sectional area as the feed portion 104, thereby enabling constant cross-sectional area waveguides to be retrofitted to perform mode conversion by adding the dielectric material 110 to the waveguides.

Figure 2:
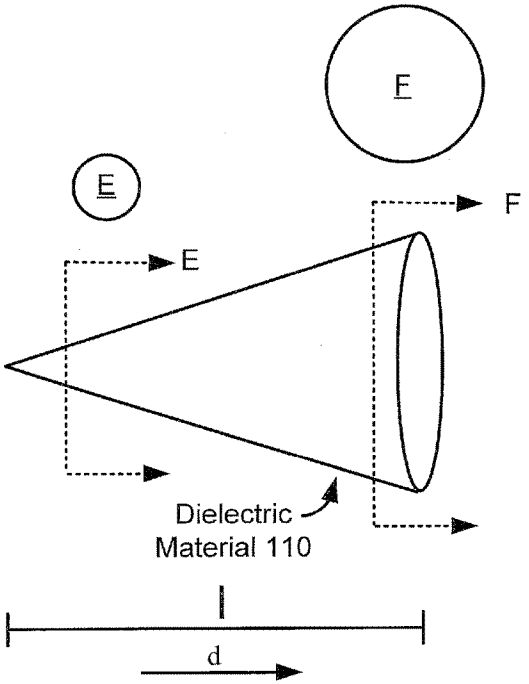
FIG. 2 illustrates a perspective view of a dielectric material (of a mode transition portion of the waveguide) that has a conical taper.

In some examples, the cross-sectional area of the dielectric material 110 increases along the length of the portion 106 in the direction from the first end 114 to the second end 116 (e.g., in the direction d in FIG. 1E). In some examples, the dielectric material 110 has a dimension (e.g., a radius) that varies linearly along the length of the portion 106. For example, FIG. 2 illustrates an example of the dielectric material 110 of FIG. 1E having a cross-sectional area that increases along the length of the portion 106 in the direction d in FIG. 1E, and the dielectric material 110 has a conical shape (e.g., a conical geometry). In this example, the cross-sectional area at E of the dielectric material 110 corresponds to the area of the circle E and the cross-sectional area at F of the dielectric material 110 corresponds to the area of the circle F. In this example, the cross sectional area at F is larger than the cross-sectional area at E, and the cross-sectional area of the dielectric material 110 increases along the length in the direction d.

Figure 3:
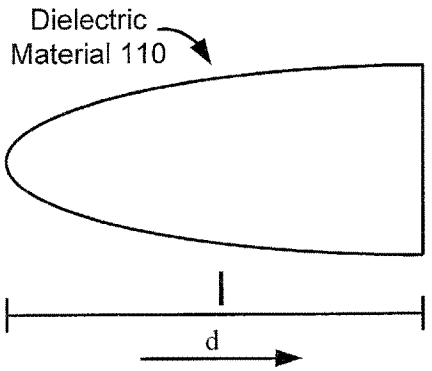
FIG. 3 illustrates a side view of a dielectric material (of a mode transition portion of the waveguide) that has an elliptic taper.
Figure 4:
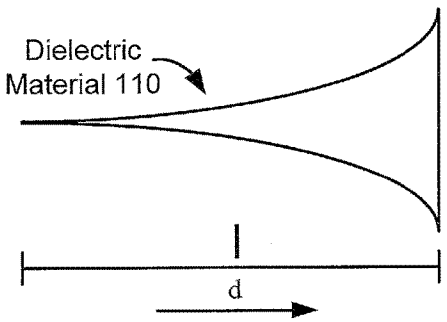
FIG. 4 illustrates a side view of a dielectric material (of a mode transition portion of the waveguide) that has a logarithmic taper.

Although the dielectric material 110 is illustrated as having a conical shape in FIG. 2, in other examples the dielectric material 110 may have a different tapered shape. For example, the dielectric material 110 may have an elliptic or logarithmic taper. For example, FIG. 3 illustrates the dielectric material 110 of FIG. 1E having an elliptic taper along the length in the direction d, and FIG. 4 illustrates the dielectric material 110 of FIG. 1E having a logarithmic taper along the length in the direction d.

With reference again to FIG. 1E, the waveguide 100 includes the mode combiner portion 108 between the portion 106 and the second end 116. The mode combiner portion 108 includes an interior region 198 (see FIG. 1D) defined or bounded by the inner surface 197 in FIG. 1D of the waveguide wall 102 along a length of the mode combiner portion 108 of the waveguide 100. In some implementations (e.g., for a circular waveguide), the interior region 198 has a cross-sectional area (A) corresponding to $A=\pi R^2$ (Equation 3) along the length of the mode combiner portion 108, where R corresponds to the radius R of a cross-section of the interior region 198. In other implementations (e.g., for a square or a rectangular waveguide), the interior region 198 of the waveguide 100 has a cross-sectional shape other than a circle. In these examples, the interior region 198 of the mode combiner portion 108 has a cross-sectional area that is defined using a different relation than the relation of Equation 3. For example, as described above, the waveguide wall 102 may be square or rectangular (e.g., the inner surface 197 of the waveguide wall 102 may define a square or a rectangle). To illustrate, the inner surface 197 along the mode combiner portion 108 may define a square, and the interior region 198 may have a cross-sectional area corresponding to a length (of a cross-sectional shape defined by the inner surface 197 along the mode combiner portion 108) squared. As another example, the inner surface 197 along the mode combiner portion 108 may define a rectangle, and the interior region 198 may have a cross-sectional area corresponding to a length of a cross-sectional shape defined by the inner surface 197 along the mode combiner portion 108 times a width of the cross-sectional shape.

The interior region 198 of the mode combiner portion 108 has a lower permittivity than an interior region of the portion 106. In some examples, the interior region of the mode combiner portion 108 is filled with air, which has a lower permittivity than the dielectric material 110.

A cross-sectional area of the interior region 198 along the length of the mode combiner portion 108 may be substantially the same as a cross-sectional area of the interior region 196 in FIG. 1C along the length of the portion 106. The mode combiner portion 108 may be associated with the dominant (e.g., a TE11) propagation mode such that energy in the secondary (e.g., a TM11) propagation mode extinguishes as it propagates along the mode combiner portion 108 in the direction d. Additionally, the mode combiner portion 108 has a length that causes energy propagating in the dominant propagation mode and energy propagating in the second propagation mode to have a particular phase difference at the second end 116. The particular phase difference may result in cancellation of longitudinal edge current. Cancellation of the longitudinal edge current may reduce a side lobe energy of a radiation pattern of a signal transmitted at the second end 116.

The waveguide 100 includes the index matcher 112, as shown in FIGS. 1A and 1E. The index matcher 112 is located proximate to the second end 116 and may be formed of dielectric material. The index matcher 112 may support propagation of the signal 103 in the second propagation mode. As described above, portions of the signal 103 in the second propagation mode may be extinguished as the signal 103 propagates through the mode combiner portion 108. The index matcher 112 may serve to control an amount of a signal transmitted by the waveguide 100 that is in the second propagation mode.

The waveguide 100 includes an index matcher 112. The index matcher 112 is located proximate to the second end 116 and may be formed of dielectric material. The index matcher 112 may support propagation of the signal 103 in the second propagation mode. As described above, portions of the signal 103 in the second propagation mode may be extinguished as the signal 103 propagates through the mode combiner portion 108. The index matcher 112 may serve to control an amount of a signal transmitted by the waveguide 100 that is in the second propagation mode.

Figure 5:
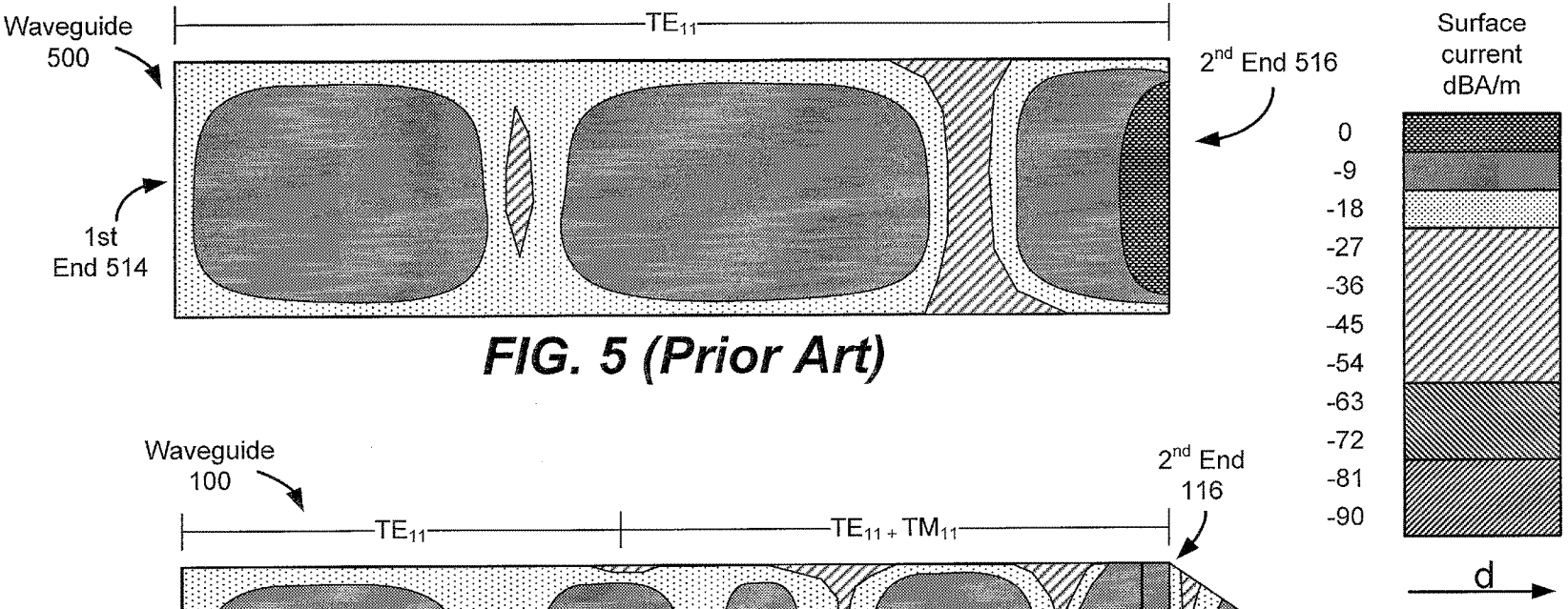
FIG. 5 (Prior Art)
FIG. 5 illustrates an example of surface currents of a circular waveguide that does not include the mode transition portion of FIG. 1A.

FIG. 5 illustrates a simulation of surface currents in a circular waveguide that does not include the dielectric material 110 and the index matcher of FIGS. 1A and 1E. In FIG. 5, a signal enters the waveguide 500 at a first end 514 and propagates along the entire length of the waveguide in the TE11 mode. The surface current at a second end 516 of the waveguide 500 includes longitudinal current components at about zero (0) dBA/m.

Figure 6:
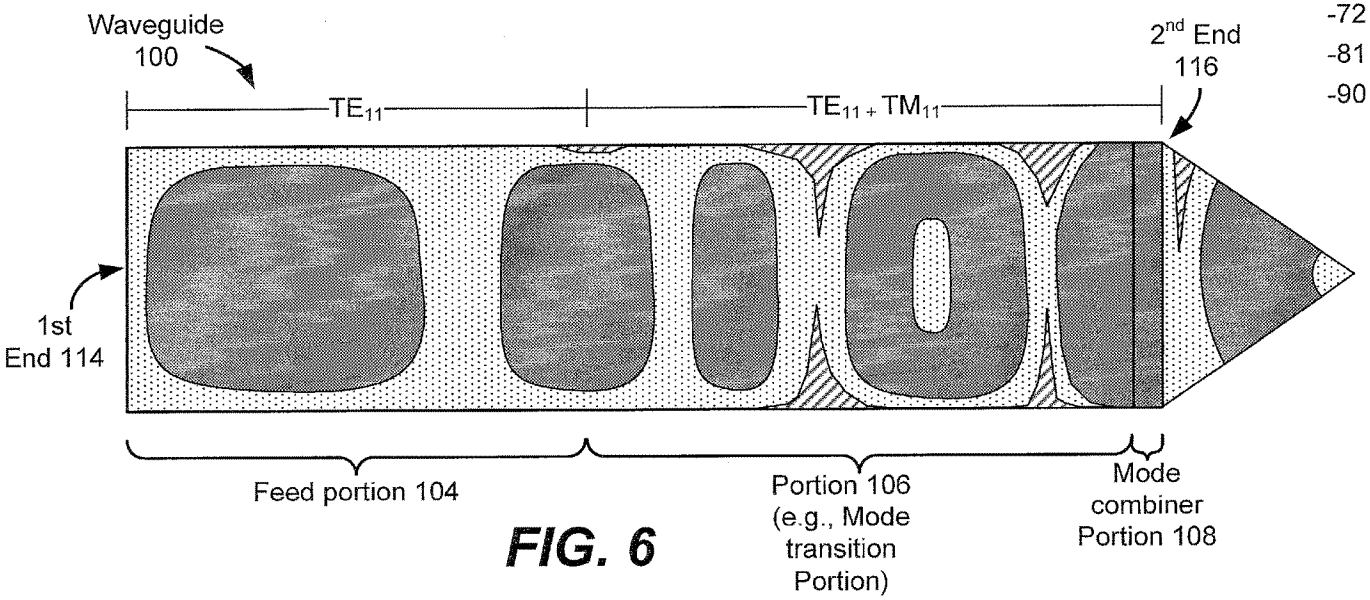
FIG. 6 illustrates an example of surface currents of a circular waveguide that includes the mode transition portion of FIG. 1A.

FIG. 6 illustrates a simulation of surface currents in the waveguide 100 of FIGS. 1A and 1E. In FIG. 6, a signal enters at the first end 114 and propagates along the feed portion 104 in the TE11 mode. The signal propagates from the feed portion 104 to the portion 106. As the signal enters and propagates along the portion 106 toward the second end 116, the dielectric material 110 of FIG. 1E causes portions of the signal to change propagation modes from the TE11 mode to the TM11 mode, resulting in a mixed or multi-mode signal (a signal having portions in both the TE11 mode and the TM11 mode). The signal propagates from the portion 106 to the mode combiner portion 108. As described above, the mode combiner portion 108 has a length that causes energy propagating in the dominant mode (TE11 mode) and the energy propagating in the second mode (TM11 mode) to have a particular phase difference at the second end 116. The particular phase difference may result in cancellation of longitudinal edge current at the second end 116. Thus, the surface current at the second end 116 is lower (e.g., about −9 dBA/m) than the surface current at the second end 516 of FIG. 5.

Figure 7:
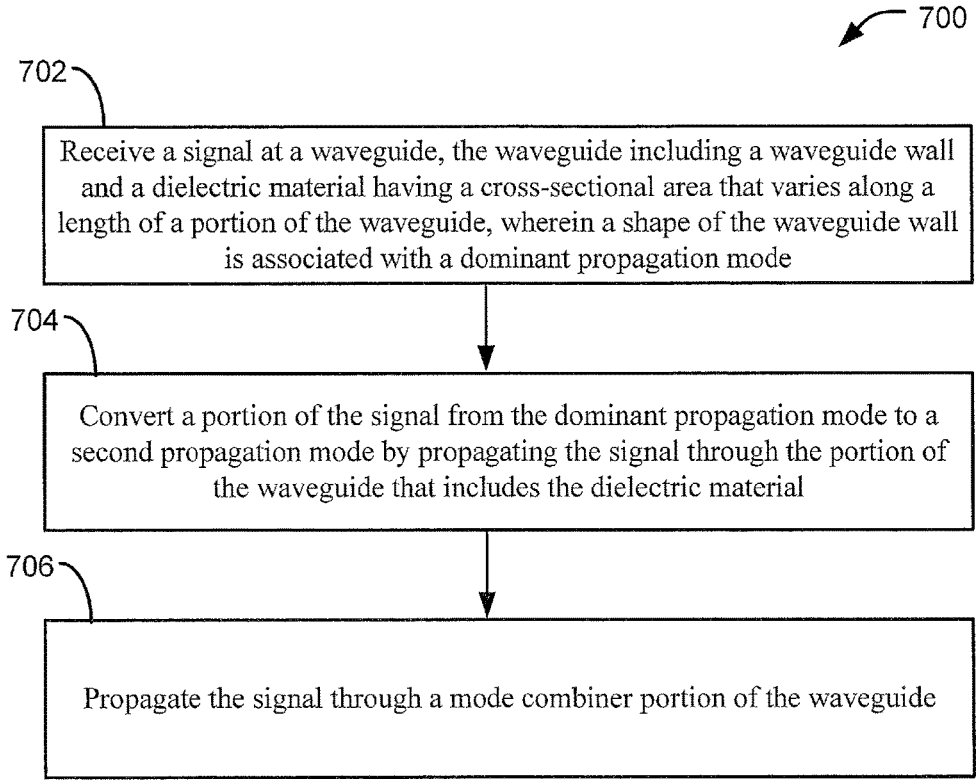
FIG. 7 is a flow chart that illustrates a particular example of a method of propagating a signal through a waveguide including dielectric material having a cross-sectional area that varies along a length of a portion of the waveguide.

FIG. 7 illustrates a method 700 of propagating a signal through a waveguide including dielectric material having a cross-sectional area that varies along a length of a portion of the waveguide. The method 700 of FIG. 7 may be performed by the waveguide 100 of FIGS. 1A and 1E.

The method 700 of FIG. 7 includes, at block 702, receiving a signal at a waveguide that includes a waveguide wall and a dielectric material having a cross-sectional area that varies along a length of a portion of the waveguide. The signal may correspond to the signal 103 of FIG. 1E. The waveguide may correspond to the waveguide 100 of FIGS. 1A and 1E, the waveguide wall may correspond to the waveguide wall 102 of FIGS. 1A, 1B, 1C, 1D, and 1E, and the dielectric material may correspond to the dielectric material 110 of FIGS. 1C, 1E, 2, 3, and/or 4. The portion may correspond to the portion 106 of FIGS. 1A and 1E. A shape of the waveguide wall is associated with a dominant propagation mode as described above with reference to FIG. 1A.

The method 700 of FIG. 7 includes, at block 704, converting a portion of the signal from the dominant propagation mode to a second propagation mode by propagating the signal through the portion of the waveguide that includes the dielectric material. For example, the waveguide may be a circular waveguide, and the portion may convert portions of the signal from the TE11 mode to the TM11 mode as described above with reference to the waveguide 100 of FIG. 1A.

The method 700 of FIG. 7 further includes providing a particular phase difference between portions of the signal propagating in the dominant propagation mode and portions of the signal propagating in the second propagation mode by, at block 706, propagating the signal through a mode combiner portion of the waveguide. The mode combiner portion may correspond to the mode combiner portion 108, and the mode combiner portion may provide a particular phase difference based on a length of the mode combiner portion as described above. The particular phase difference may cause cancellation of longitudinal edge currents as described above.

As described above, the cross-sectional area of an interior region of the waveguide may be constant (or substantially constant). In this implementation, the waveguide (e.g., the portion 106 (including the dielectric material 110)) emulates a perturbation in the waveguide wall 102 to convert energy from a dominant propagation mode to the secondary propagation mode without relying on perturbations in the waveguide wall 102. Thus, the portion 106 converts propagation modes using an interior region 196 having the same (or substantially the same) cross-sectional area as the interior region 195 of the feed portion 104, thereby enabling constant cross-sectional area waveguides to be retrofitted to perform mode conversion by adding the dielectric material 110 to the waveguides.

Figure 8:
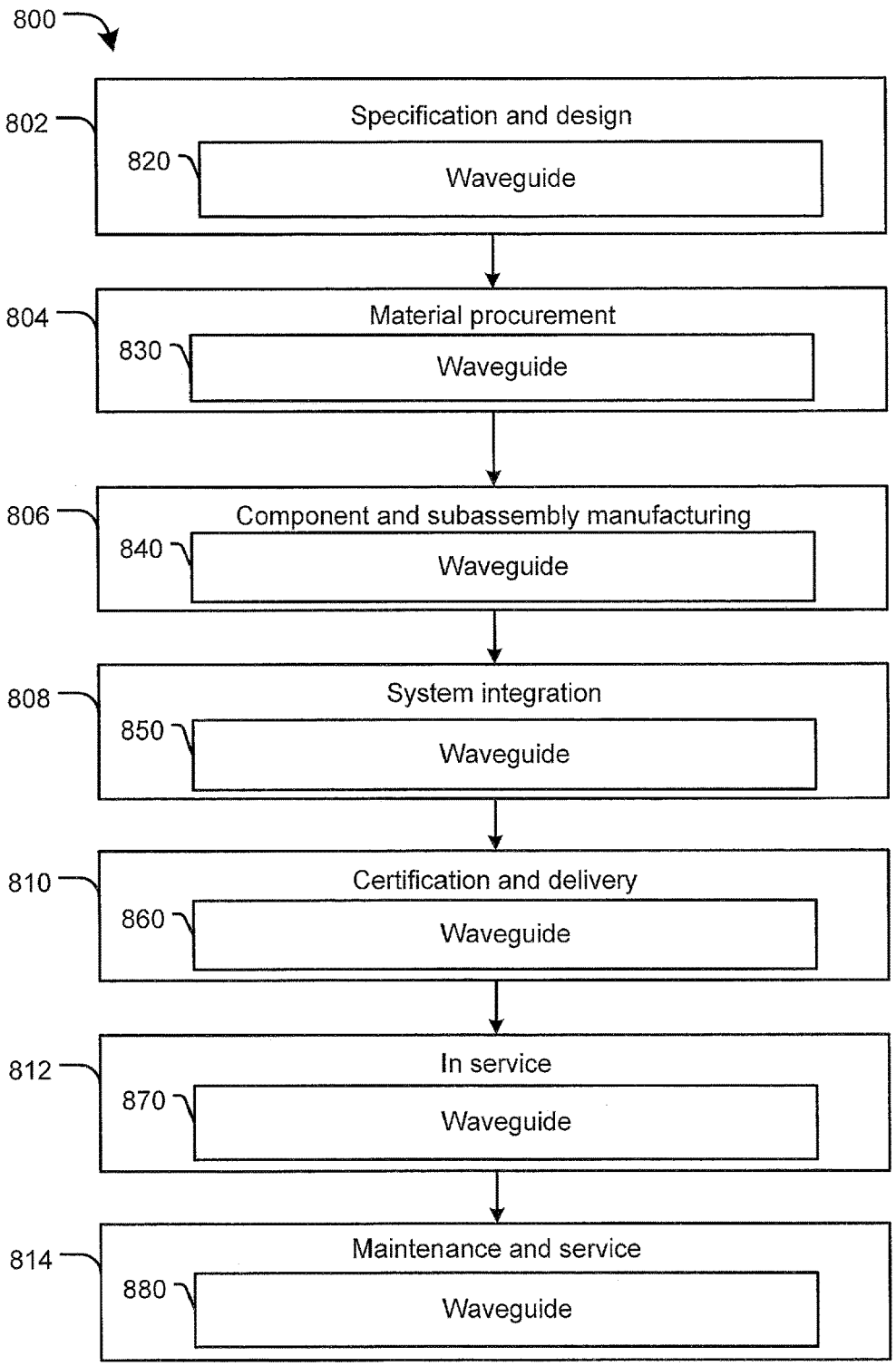
FIG. 8 is a flow chart illustrative of a life cycle of an aircraft that includes a waveguide including a mode transition portion.

Referring to FIG. 8, a flowchart illustrative of a life cycle of a platform, such as a vehicle (e.g., a land vehicle, an aerial vehicle, or a water vessel) or a ground-based installation (e.g., a building or a structure) including a waveguide that performs mode conversion without waveguide wall perturbations is shown and designated 800. During pre-production, the exemplary method 800 includes, at block 802, specification and design of a platform, such as the aircraft 902 described with reference to FIG. 9. During specification and design of the platform, the method 800 may include, at block 820, specification and design of a signal receiver or a signal transmitter having a waveguide. The signal receiver or the signal transmitter may be part of a communication system, such as the communication system 960 of FIG. 9, that may employ an antenna, such as the antenna 903 of FIG. 9 (that includes the waveguide), to transmit or receive a signal, such as the signal 103 of FIG. 1E. The waveguide may correspond to the waveguide 100 of FIGS. 1A and 1E. At block 804, the method 800 includes material procurement. At block 830, the method 800 includes procuring materials for the waveguide, such as the dielectric material 110 of FIGS. 1C and 1E.

During production, the method 800 includes, at block 806, component and subassembly manufacturing and, at block 808, system integration of the platform. The method 800 may include, at block 840, component and subassembly manufacturing (e.g., producing the waveguide 100 or adding the dielectric material 110 and/or the index matcher 112 to an existing constant cross-sectional area waveguide) and, at block 850, system integration of the waveguide. For example, the waveguide may be integrated into or used in connection with an antenna, such as the antenna 903 of FIG. 9. At block 810, the method 800 includes certification and delivery of the platform and, at block 812, placing the platform in service. Certification and delivery may include, at block 860, certifying the waveguide. At block 870, the method 800 includes placing the waveguide in service. While in service by a customer, the platform may be scheduled for routine maintenance and service (which may also include modification, reconfiguration, refurbishment, and so on). At block 814, the method 800 includes performing maintenance and service on the platform. At block 880, the method 800 includes performing maintenance and service of the waveguide. For example, maintenance and service of the waveguide may include replacing the waveguide 100 or the dielectric material 110.

Each of the processes of the method 800 may be performed or carried out by a system integrator, a third party, and/or an operator (e.g., a customer). For the purposes of this description, a system integrator may include without limitation any number of manufacturers and major-system subcontractors; a third party may include without limitation any number of venders, subcontractors, and suppliers; and an operator may be an airline, a leasing company, a military entity, a service organization, and so on.

Figure 9:
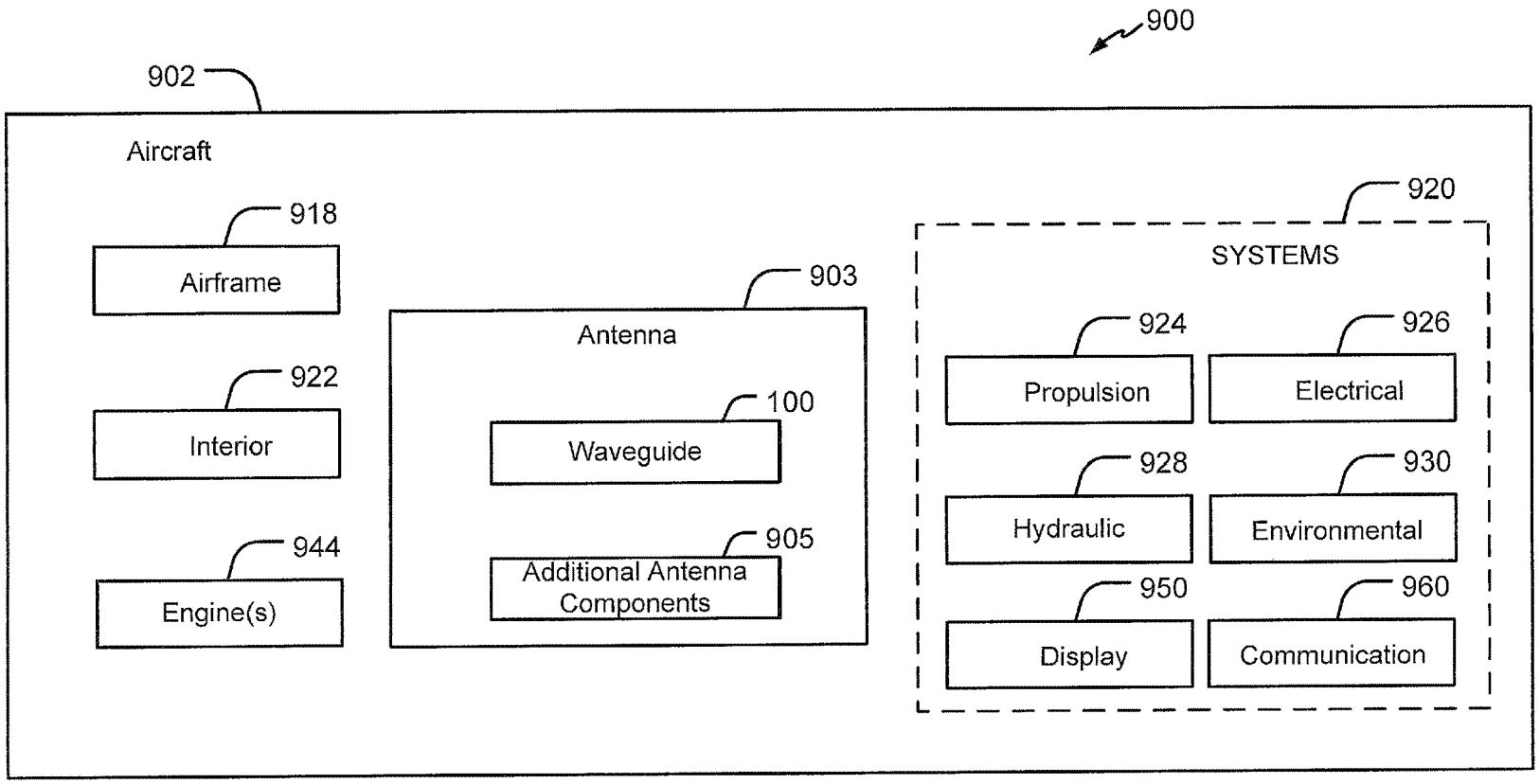
FIG. 9 is a block diagram of an illustrative embodiment of an aircraft that includes a waveguide including a mode transition portion.

Referring to FIG. 9, a block diagram of an illustrative embodiment of an aircraft (e.g., an airplane or a drone) 902 that includes a waveguide 100 configured to perform mode conversion is shown and designated 900. As shown in FIG. 9, the aircraft 902 produced by the method 800 may include an airframe 918, an interior 922, one or more engines 944, an antenna 903, and a plurality of systems 920. The systems 920 may include one or more of a propulsion system 924, an electrical system 926, a hydraulic system 928, an environmental system 930, a display system 950, and a communication system 960. Any number of other systems may be included. The antenna 903 includes the waveguide 100 and additional antenna components 905, such as a reflective dish. The antenna 903 may be part of the communication system 960 and the one or more engines 944 may be part of the propulsion system 924.

Apparatus and methods embodied herein may be employed during any one or more of the stages of the method 800. For example, components or subassemblies corresponding to the production process 808 may be fabricated or manufactured in a manner similar to components or subassemblies produced while the aircraft 802 is in service, for example at block 812. Also, one or more of apparatus embodiments, method embodiments, or a combination thereof may be utilized while the aircraft 902 is in service, at block 812 for example and without limitation, to maintenance and service, at block 814. For example, the waveguide 100 of FIGS. 1A and 1E may be part of, or used in connection with, an antenna, such as the antenna 903 of FIG. 9, which is used to transmit a signal, such as the signal 103 of FIG. 1E while the aircraft 902 is in service.

The illustrations of the examples described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than shown in the figures or one or more method steps may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. As the following claims reflect, the claimed subject matter may be directed to less than all of the features of any of the disclosed examples.

Examples described above illustrate but do not limit the disclosure. It should also be understood that numerous modifications and variations are possible in accordance with the principles of the present disclosure. Accordingly, the scope of the disclosure is defined by the following claims and their equivalents.

What is claimed is:

1. An apparatus comprising:
a waveguide including:
a feed portion;
a mode combiner portion;
a mode transition portion located between the feed portion and the mode combiner portion;
a waveguide wall having a shape associated with a dominant propagation mode; and
a first dielectric material having a cross-sectional area that varies along a length of a portion of the waveguide, wherein an interior region of the mode combiner portion has a lower permittivity than an interior region of the mode transition portion.

2. The apparatus of claim 1, wherein the waveguide wall has a circular cross-section and the dominant propagation mode comprises a transverse electric 11 (TE11) mode.

3. The apparatus of claim 2, wherein the first dielectric material has a tapered shape.

4. The apparatus of claim 3, wherein the tapered shape comprises a conical shape, an elliptic shape, or a logarithmic shape.

5. The apparatus of claim 2, wherein the first dielectric material has a dimension that varies linearly along the length of the portion of the waveguide.

6. The apparatus of claim 1, wherein a cross-sectional area of an interior region along the feed portion, a cross-sectional area of the interior region along the mode combiner portion, and a cross-sectional area of the interior region along the mode transition portion are substantially equal.

7. The apparatus of claim 1, wherein the waveguide further comprises an index matcher comprising a second dielectric material, the index matcher disposed proximate to a second end of the waveguide.

8. The apparatus of claim 7, wherein the portion of the waveguide includes the mode transition portion, and wherein the mode combiner portion is disposed between the mode transition portion and the second end.

9. The apparatus of claim 8, wherein the feed portion is disposed between the mode transition portion and a first end of the waveguide, and wherein an interior region of the feed portion has a lower permittivity than the interior region of the mode transition portion.

10. The apparatus of claim 9, wherein a cross-sectional area of an interior region of the waveguide is substantially constant along a length of the mode transition portion.

11. The apparatus of claim 10, wherein the cross-sectional area of the interior region of the waveguide is substantially constant along the feed portion, and wherein the cross-sectional area of the interior region along the length of the mode transition portion and the cross-sectional area of the interior region along the feed portion are substantially equal.

12. A waveguide comprising:
a feed portion;
a mode combiner portion;
a mode transition portion including a dielectric material, the mode transition portion located between the feed portion and the mode combiner portion, wherein an interior region of the mode combiner portion has a lower permittivity than an interior region of the mode transition portion; and an index matcher comprising the dielectric material, wherein the mode combiner portion is located between the index matcher and the mode transition portion.

13. The waveguide of claim 12, wherein the dielectric material has a cross-sectional area that varies along a length of the mode transition portion.

14. The waveguide of claim 13, wherein the dielectric material has a tapered shape.

15. The waveguide of claim 12, wherein a cross-sectional area of the interior region along the feed portion, a cross-sectional area of an interior region along the mode combiner portion, and a cross-sectional area of the interior region along the mode transition portion are substantially equal.

16. A method comprising:

receiving a signal at a waveguide, the waveguide comprising a waveguide wall and a dielectric material having a cross-sectional area that varies along a length of a portion of the waveguide, wherein a shape of the waveguide wall is associated with a dominant propagation mode; and converting a portion of the signal from the dominant propagation mode to a second propagation mode by propagating the signal through the portion of the waveguide that includes the dielectric material, wherein the portion of the waveguide comprises a mode transition portion between a feed portion and a mode combiner portion, and wherein an interior region of the mode combiner portion has a lower permittivity than an interior region of the mode transition portion.

17. The method of claim 16, wherein the waveguide wall has a circular cross-section and the dominant propagation mode comprises a transverse electric 11 (TE11) mode.

18. The method of claim 16, wherein the second propagation mode comprises a transverse magnetic 11 (TM11) mode.

19. The method of claim 16, further comprising propagating the signal through the mode combiner portion of the waveguide.

20. The method of claim 16, wherein the mode combiner portion has a length that causes energy propagating in the dominant propagation mode and energy propagating in the second propagation mode to have a target phase difference at an end of the waveguide wall.

* * * * *